United States Patent [19]

Hinton et al.

[11] 4,384,845

[45] May 24, 1983

[54] FAIL SAFE DIGITAL FUEL IGNITION SYSTEM

[75] Inventors: Brian J. Hinton, Crystal; William M. Papic, Eden Prairie, both of Minn.

[73] Assignee: Honeywell Inc., Minneapolis, Minn.

[21] Appl. No.: 286,912

[22] Filed: Jul. 27, 1981

[51] Int. Cl.[3] ..... F23Q 23/00

[52] U.S. Cl. ..... 431/26; 431/25; 431/46

[58] Field of Search ..... 431/24, 25, 26, 46, 431/78, 73

[56] References Cited

U.S. PATENT DOCUMENTS 3,711,237 1/1973 Jaulmes .

4,192,641 3/1980 Nakagawa et al. .

4,238,184 12/1980 Schilling .

*Primary Examiner*—Carroll B. Dority, Jr.

*Attorney, Agent, or Firm*—Alfred N. Feldman

[57] ABSTRACT

A fuel burner control system that is fail safe and which controls three fuel burner functions is provided for. The system utilizes two different digital clock means that are separated in time from one another to ensure separate gating of the fuel burner output functions. The system further uses a negative power supply with respect to the circuit ground for control purposes while energizing the output switch means with a positive potential thereby eliminating inadvertent operation in the event of circuit component failures.

10 Claims, 2 Drawing Figures

FAIL SAFE DIGITAL FUEL IGNITION SYSTEM

BACKGROUND OF THE INVENTION

In recent years the escalating cost of fuel, particularly natural gas, has caused a significant change in the manner in which gas fuel burners have been operated. When the cost of natural gas was relatively low, many gas operated appliances used for space heating were operated with pilot lights that were continuously burning and which were monitored by a thermocouple or other simple heat responsive safety device. These types of systems were generally referred to as standing pilot burner systems.

The standing pilot burner system uses a small amount of fuel continuously, but was a very inexpensive type of ignition system that proved to be very reliable. With the advent of the rapidly rising cost of natural gas, the use of standing pilots has become of questionable economic value. In some places the use of standing pilot configurations in new installations has been legislated out of existence. To replace the standing pilot systems, new styles of electronically controlled and spark ignited pilot systems have become common. These new types of systems normally use a spark generator to ignite natural gas flowing from a pilot burner. Once the natural gas is ignited, the pilot is then in turn used to ignite a main burner. The monitoring of the pilot flame is typically accomplished in these systems by the well known technique of flame rectification sensing. In flame rectification sensing, a voltage is applied between a flame rod and the pilot burner and is capable of sensing the presence or absence of flame by a change in conduction of current through a circuit that includes the flame. The spark ignited type of pilot system typically utilizes a relaxation type of oscillator to generate the spark and then uses relays that are controlled by soild state gated switches, such as, silicon controlled rectifiers for control of fuel to the pilot burner and to the main burner. These systems are susceptible of false operation by the generation of electrical noise or interference that improperly gates the solid state switches. The spark generator is a primary source of noise and can falsely gate or trigger the soild state switches thereby creating a system operation that is undesirable, and even possibly unsafe. The filtering of this type of electrical noise, and the safe operation of the solid states switches has become a significant problem.

SUMMARY OF THE INVENTION

The present invention is directed to a fail safe type of control system that is capable of operating a fuel burner that has three separate fuel burning functions such as an ignition source, a pilot fuel control source, and a main burner fuel control source. The fail safe control system uses a digital signal processing technique that provides the control of the three separate fuel burner functions by use of two different digital clock signals that are separated in time phase. By utilizing at least two different time phased signals, the spark generating or ignition generating source can be operated with a signal that is time or phase separated from the signal that is used to control the main fuel valve. As such, there is less likelihood that stray electrical noise will inadvertently cause an unsafe mode of operation of the device.

In addition to utilizing two different time displaced signals in the present control system, the system relies on the use of a power supply that has a negative potential with respect to the circuit ground as a source for gating solid state switch means through coupling capacitors. The soild state switch means are energized with a potential that is positive with respect to the circuit ground, and therefore the only way they can be turned on or gated is with a pulsed circuit that is coupled to the gates of the solid state switch means through capacitors. This arrangement further protects against inadvertent operation of the solid state switch means by a failure in the control circuitry which would apply an undesirable potential to the gate of any one of the solid state switch means.

DESCRIPTION OF THE PREFERRED EMBODIMENTS

Figure 1:
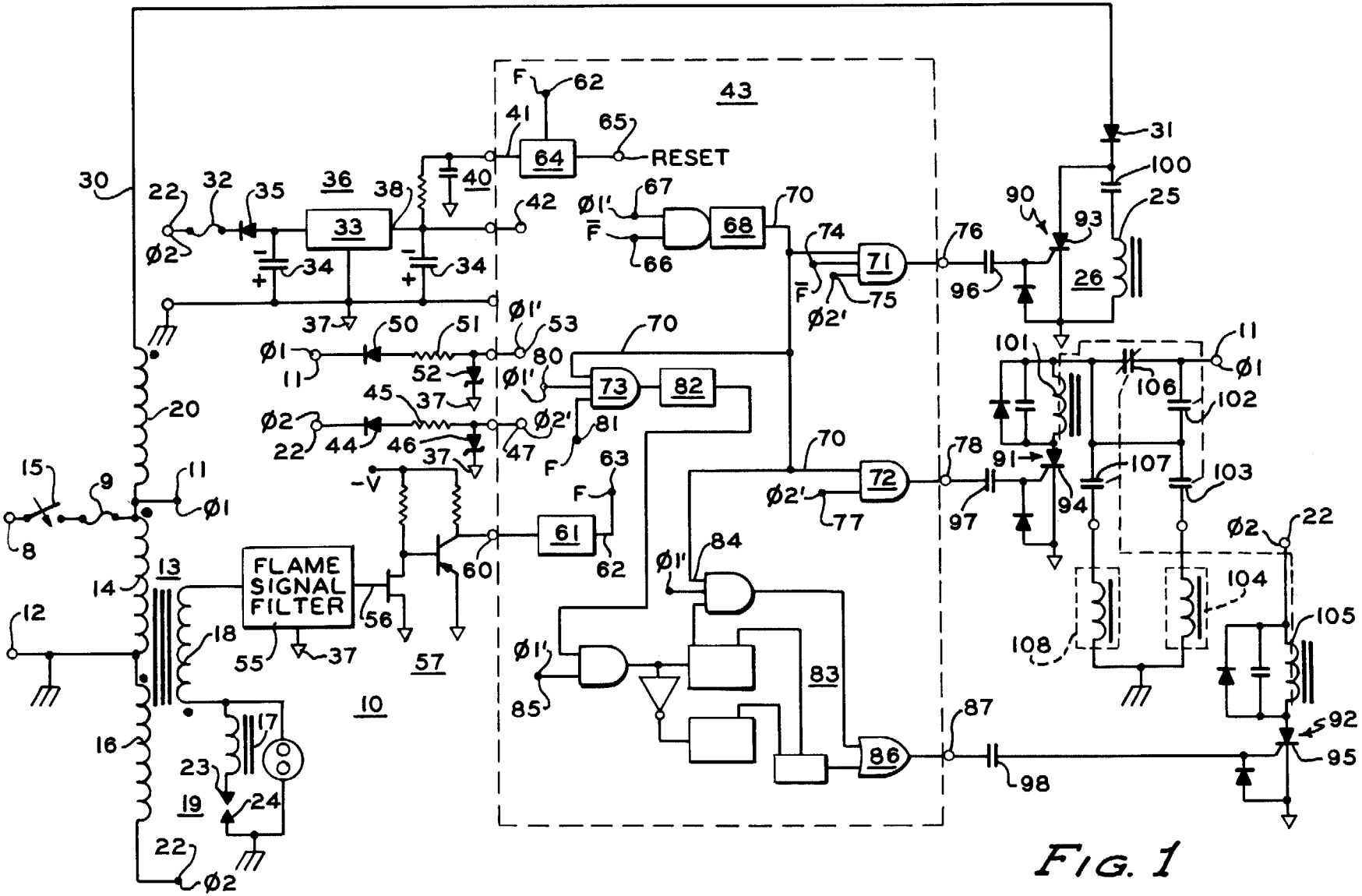
FIG. 1 is a block diagram of a complete control system.

In FIG. 1 there is disclosed a combination schematic and block diagram of a control system designed to operate a fuel burner with three separate fuel burner functions. The control system is generally referenced at 10 and has a pair of terminals 8 and 12 that are adapted to be connected to a conventional source of alternating current potential. The terminals 11 and 12 connect to a power conversion means generally disclosed at 13 in the form of a multiwinding transformer. The power conversion means 13 has a primary transformer winding 14 that is energized through a fuse 9 across the terminals 8 and 12 by a switch 15 and has a plurality of further windings 16, 18, and 20. The windings 14 and 16 terminate in a pair of terminals 11 and 22 that provide two potentials Ø1 and Ø2. In the particular arrangement disclosed the potentials Ø1 and Ø2 are derived from the windings 14 and 16 and are separated in phase by 180 electrical degrees.

In addition to the windings 14 and 16, a winding 18 provides for a voltage level for operation of flame sensing across a pair of electrodes 23 and 24 which forms a spark gap means 19 for positioning an ignition spark for a fuel burner to which the system of FIG. 1 is to be connected. A system of this nature is fully disclosed in a Schilling U.S. Pat. No. 4,238,184 issued on Dec. 9, 1980. A transformer winding 17 cooperates with a further primary winding 25 that is part of a spark generation means generally disclosed at 26 as a relaxation oscillator type of spark generator. The spark generator means 26 could be of any convenient type including a conventional copper-iron transformer that was in turn energized by a relay. This portion of the circuit will be described in more detail in connection with the disclosed relaxation oscillator means 26. The winding 20 provides a connection at 30 to a diode 31 that is the energizing circuitry for the relaxation oscillator type of spark generating means 26.

The voltage of Ø2 at connection 22 is connected through a fuse 32 to a power supply element 33 and filter capacitors 34 along with a diode 35 that makes up a power supply means generally indicated at 36. The power supply means 36 provides a 12 volt potential that is negative with respect to a system ground shown at 37. The output of the power supply means 36 is at 38, which is connected to a delay means 40 which in turn is connected at terminal 41 to a fuel burner control circuit means 43. The fuel burner control circuit means 43 will be described to some extent later. At this point it should be indicated that the terminal 41 supplies a delayed power to the fuel burner control circuit means 43 while conductor 38 is connected to a terminal 42 that supplies a potential to the fuel burner control means as a source of power for operating its components.

The terminal 22 of Ø2 is connected to a network made up of a diode 44, a resistor 45, and a zener diode 46 to the system ground 37. This arrangement provides a digital clock means that is referred at terminal 47 as the Ø2′ digital clock means. A second digital clock means is provided by connecting the terminal 11 of §1 to a diode 50, resistor 51, and a zener diode 52 that is connected to ground 37, and provides at a terminal 53 a second digital clock means referred to as the §1′ digital clock means. The digital clock means at 47 and 53 are separated by 180 degrees in time as compared to the applied alternating current voltage and are connected within the fuel burner control circuit means 43 as indicated by the notations of §1′ or §2′ to the digital logic elements within the fuel burner control circuit means 43.

The spark gap means 19 provides a means for positioning ignition sparks between the elements 23 and 24, and also provides for the detection of flame at the spark gap means. The spark gap means 19 is connected through the windings 17 and 18 to a flame signal filter generally disclosed at 55 which in turn provides a signal at a conductor 56 to indicate the presence or absence of flame to a flame amplifier or flame signal comparator circuit 57. The flame signal comparator 57 has an output at conductor 60 to a flame responsive circuit 61. A typical flame responsive circuit that would function at 61 is disclosed in detail in connection with FIG. 2, and will be described in some detail later. The output of the flame responsive circuit 61 is at a conductor 62 that is connected to a terminal 63 which has been indicated as a terminal indicating the present or absence of flame. The terminal provides a digital signal that will be referenced as F and F to indicate the presence or absence of a signal. The conductor 62 is further connected to a loss of flame reset means 64 that has an output reset signal at 65 that can be connected to the reset terminals of the digital circuitry within the fuel burner control circuit means 43.

The flame signal, as an F signal, is provided at terminal 66 along with the Ø1′ clock at terminal 67 of a digital logic circuit that provides a safe start check timer circuit means at 68. The safe start check timer means 68 can be of any conventional design and has a digital output at conductor 70 to three digital gates 71, 72, and 73. Also connected to the gate 71 is an F signal at terminal 74 and a Ø2′ clock signal at terminal 75. The gate 71 has an output at conductor 76 which is a first output means for the fuel burner control circuit means 43.

The gate 72, in addition to being connected to conductor 70 has a digital input at 77 from the Ø2′ clock and has an output at conductor 78. The output at conductor 78 is the second output means of the fuel burner control circuit means 43.

The safe start check timer means 68 controls the gate 73 along with a Ø1′ clock signal at 80, and with a flame signal F at 81. The gate 73 provides a signal to a flame signal proving timer 82 of any convenient design that is connected to a flame stabilization timer generally disclosed at 83. The flame stabilization timer 83 is gated at terminals 84 and 85 by the Ø1′ clock means and has an output gate 86 with an output conductor 87 that forms the third output means for the fuel burner control circuit means 43. The flame stabilization timer 83 is a digital timer that compares signals and provides an output gated signal at conductor 87 in response to the Ø1′ clock means after an appropriate period of time. The specific design of the flame stabilization timer means 83 is not material, and could be any type of digital timer arrangement of a safe or redundant type. The only requirement is that it provide a time for flame stabilization after flame has been detected and which is controlled by digital clock Ø1′ at the input terminals 84 and 85.

The three output means 76, 78, and 87 are connected to three solid state switch means generally disclosed at 90, 91, and 92. Each of the solid state switch means includes a gated solid state switch 93, 94, and 95 that are disclosed as silicon controlled rectifiers. The gate of the silicon controlled rectifier 93 is connected by a capacitor 96 to output means 76. The gate of the silicon controlled rectifier 94 is connected through a capacitor 97 to the output means 78, while the gate of the silicon controlled rectifier 95 is connected through a third capacitor 98 to the output conductor 87.

The silicon controlled rectifier 93 operates with a capacitor 100 and the transformer winding 25 of the spark generating means 26 to form a relaxation type of spark generator. The transformer primary 25 is coupled to the winding 17 that is connected to the spark gap means 19 so that a spark can be generated across the elements 23 and 24. The spark generating means 26 could be replaced by a relay controlled by the silicon controlled rectifier 93 which in turn energizes a conventional copper-iron transformer or a piezoelectric ignitor, or any other type of spark generating circuitry desired.

The output means 78 is coupled through the capacitor 97 to gate the silicon controlled rectifier 94 which is connected to a relay means 101 that controls a pair of contacts 102 and 103. The pairs of contacts 102 and 103 in turn are adapted to be connected to a pilot valve disclosed at 104. The pilot valve 104 is the second burner function controlled by the present system.

The system is completed by connecting the output 87 through the coupling capacitor 98 to the silicon controlled rectifier 95 which controls a further electromagnetic relay means 105. Relay 105 controls a normally closed contact 106 and a normally open contact 107 and is adapted to energize a main valve means 108. The main valve 108 is the third burner function controlled by the present circuitry.

It will be noted that the relay contact configuration of the contacts 102, 103, 106, and 107 are energized from a Ø1 terminal 11, while the relay 105 is energized from a Ø2 terminal 22 thereby separating the burner control loads of the device by the power being separated in phase, which will be coordinated with the manner in which the three separate fuel burner functions are operated.

OPERATION OF FIG. 1

When power is supplied to the terminals 11 and 12, the power supply means 36 develops a negative 12 volt potential at the conductor 38 to power the fuel burner control circuit means 43. At the same time, the delay means 40 is energized and provides a reset hold to the fuel burner control circuit means for approximately 100 milliseconds. After the 100 millisecond hold, the circuitry within the fuel burner control circuit means 43 begins to check for the presence of flame at the spark gap means 19. If a flame signal is detected, the circuitry of the fuel burner control circuit means 43 enters an electric lockout condition until the flame signal is no longer present. When the flame signal is no longer detected, the circuit 43 is reset and the presence of flame is checked for once again. If no flame signal is detected, the Ø1' clock pulses at terminal 53 are gated to the safe start check timer 68. If no flame signal is then detected during this time period, the timer is allowed to time out and the inputs of gate 71 and 72 provide output pulses at the conductors 76 and 78 which are coupled through the capacitors 96 and 97. The output signal at the conductors 76 and 78 are negative due to the negative power supply means 36, but after being coupled through the capacitors 96 and 97 are capable of gating the silicon controlled rectifiers 93 and 94 into conduction. This allows the relaxation oscillator spark ignitor 26 to generate a spark potential by discharging the capacitor 100 periodically through the primary winding 25 and coupling that voltage to the transformer secondary 17 where a spark is generated across the electrodes 23 and 24. At this same time the silicon controlled rectifier 94 has begun to conduct and energizes the relay 101 thereby closing the contacts 102 and 103. This allows for the energization of the pilot valve means 104 to supply gas to a pilot burner.

When sparks at the spark gap mean 19 ignite pilot gas, this is detected by the flame signal comparator 57 and the flame responsive circuit 61 to provide an output flame signal at 63 as shown at F. The change in state at terminal 63 is connected to terminal 74 and the gate 71 is turned "off" in the presence of flame so the output at conductor 76 ceases and the silicon controlled rectifier 93 ceases to provide a spark. This change is also connected to terminal 81 where the gate 73 starts the flame signal proving timer 82 to determine whether a flame in fact exists when the spark is off.

This time period checks for a flame signal without the presence of an ignition spark. If the flame signal is detected throughout this period of time, then the Ø1' clock is gated to the flame stabilization timer disclosed at 83. After the operation of the flame stabilization timer 83, the gate 86 is activated and an output is provided at the conductor 87 that is coupled through capacitor 98 to the silicon controlled rectifier 95. This allows for the energization of the relay 105 from the Ø2 terminal 22, and this provides for the opening of the contact 106 and the closing of the main valve contact 107 to energize the main valve 108. This provides for energization of the main burner which lights from the pilot. If the flame is lost, this is immediately detected by the spark gap means 19 and the spark generating means 26 is reactivated.

With the present arrangement three separate burner functions are operated by a digital circuit processing arrangement that utilizes two digital clock means which have outputs that are separated in time from one another. This causes the operation of the solid state switch means 90, 91, and 92 to be separated in time phase. The noise signals which would be generated by the circuitry, or which are available in the ambient in which the electronics is operated is prevented from inadvertently operating part of the circuit causing an unsafe condition. By energizing the pilot valve 104 and the main valve 108 from a Ø1 terminal 11, and the relay 105 from a Ø2 terminal 22, it is possible to separate their operating times and prevent inadvertent operation of the device. Also, in the present device, if any of the capacitors 96, 97, or 98 become shorted and couple a signal directly to the gate of its associated silicon controlled rectifier, the signal is a negative potential with respect to the circuit ground and would be incapable of causing the silicon controlled rectifier to conduct since the silicon controlled rectifiers are energized from a positive potential in each case. With this arrangement inadvertent failures within the device are isolated and cannot operate the output loads in an unsafe manner.

Figure 2:
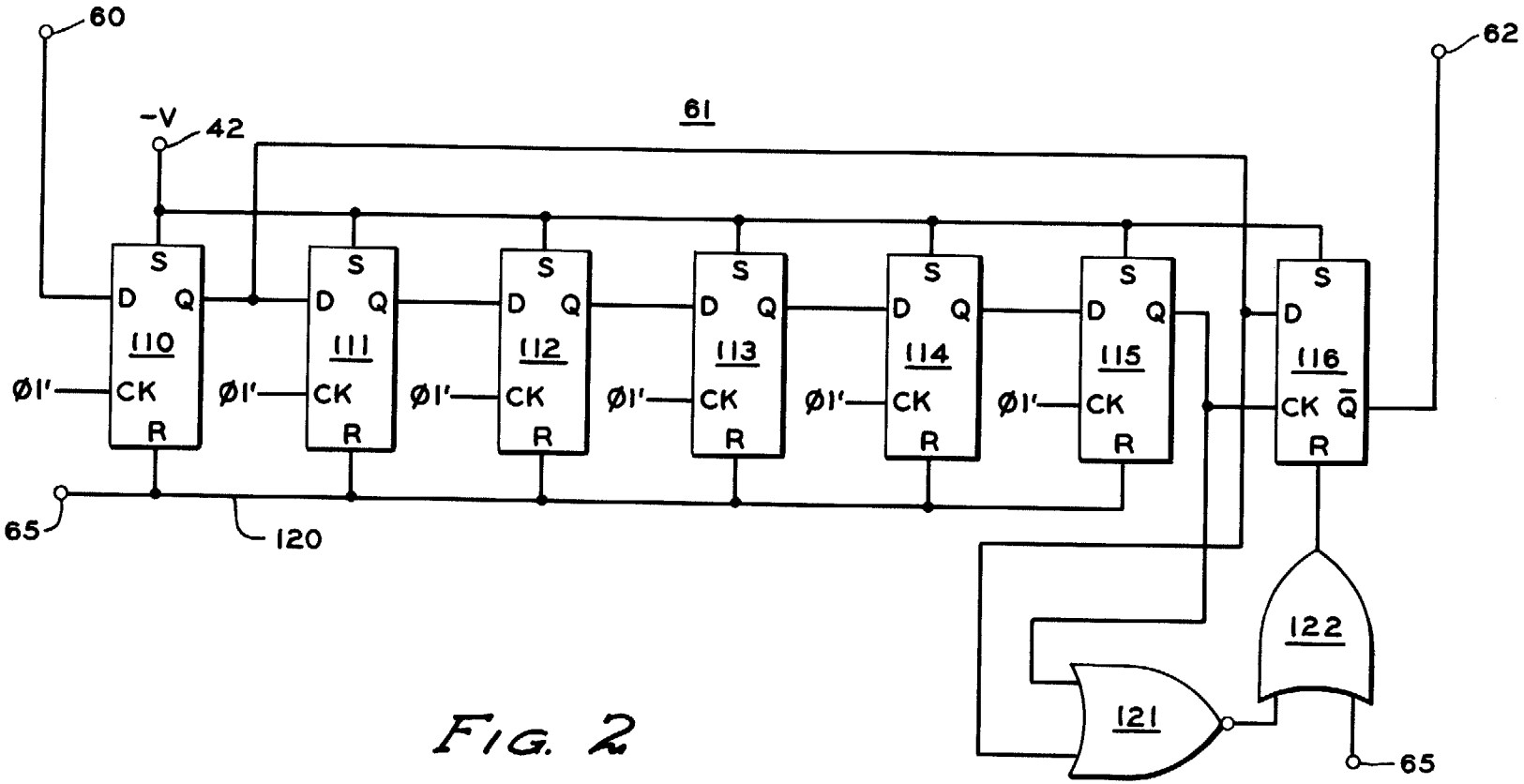
FIG. 2 is an embodiment of the digital implementation of one portion of the circuit of FIG. 1.

In FIG. 2 the flame responsive circuit 61 is shown in detail. The input conductor 60 is connected to a first of a series of C-D flip-flops 110. There are a series of C-D flip-flops 110, 111, 112, 113, 114, 115, and 116. Six of the C-D flip-flops 110 through 115 are gated from the Ø1' clock at its clock input and has its source connected to the negative potential from the power supply at terminal 42. Six of the C-D flip-flops are connected to a common reset conductor 120 which in turn is controlled by the reset terminal 65. The C-D flip-flop 116 provides the output of the flame responsive circuit at terminal 62. A NOR gate 121 and an OR gate 122 provides a reset function. This circuit delays a digital signal from 83.3 milliseconds to 99.9 milliseconds if a 60 hertz signal is applied to the Ø1' clock. This circuit provides for a delay in the detection of a flame signal but does not allow for a change in state unless the input remains at a constant level for a period of at least 83.3 milliseconds. The flame responsive circuit means 61 has been disclosed in detail as an example of one means of implementing part of the digital logic.

The digital logic contained in the fuel burner control circuit means 43 can be implemented by numerous means and is not material to the present invention. The present invention specifically encompasses the idea of using two digital clock means that have clock output pulses that are separated in time from one another as the means to energize or control the gating of three different fuel burner functions. The invention further encompasses the idea of using a negative potential with respect to the circuit ground to energize the digital logic while using a positive potential as an input to the three output solid state switch means. By the use of a coupling capacitor between the digital logic and the solid state switch means a failure in the digital logic will not be coupled to inadvertently gate any of the solid state switch means. Also, the failing of any of the coupling capacitors will not create as unsafe condition. It is obvious that the present invention can be modified by different digital design techniques and the applicants wish to be limited in the scope of their invention solely by scope of the appended claims.

The embodiments of the invention in which an exclusive property or right is claimed are defined as follows:

1. A fail safe control system for operating a fuel burner with three separate fuel burner functions by using digital signal processing, including: power terminals adapted to be connected to a source of alternating current potential to energize said control system; power conversion means connected to said terminals to receive power from said source of alternating current potential and having a plurality of output potentials; said output potentials including at least two potentials which are separated in phase from each other; power supply means having an input connected to a first of said potentials and including voltage output means which is negative with respect to a reference potential for said control system; two digital clock means each having input means and output means with said clock means each energized from a different one of said two potentials to provide said clock means with output clock pulses at their respective output means and with said output clock pulses being separated in time from one another; spark gap means for positioning ignition sparks for said fuel burner and for flame detection; fuel burner control circuit means connected to said spark gap means to sense the presence or absence of flame; said fuel burner control circuit means including digital signal processing means and being powered from said power supply means; said fuel burner control circuit means connected to said two digital clock means to process digital signals in response to said two digital clock means; said fuel burner control circuit means having three output means with a first and a second of said output means clocked by a first of said digital clock means while a third of said output means is clocked by a second of said digital clock means; three gated solid state switch means with each switch means connected to control a separate one of said fuel burner functions with said switch means each powered by a potential that is positive with respect to said reference potential; and each of said switch means having gate means connected to the outputs of said fuel burner control circuit means; said fuel burner control circuit means controlling said solid state switch means by said digital signals which are separated in time by said two digital clock means.

2. A fail safe control system as described in claim 1 wherein a separate capacitor is connected to couple each of said gate means to said output means of said fuel burner control circuit means.

3. A fail safe control system as described in claim 2 wherein said power conversion means having a plurality of output potentials is transformer means to supply said two potentials which are separated in phase, and further potentials for powering said control system.

4. A fail safe control system as described in claim 3 wherein said power supply means is a regulated voltage supply which has an output voltage at said voltage output means that is negative with respect to a reference potential which is a ground potential for said control system.

5. A fail safe control system as described in claim 4 wherein said two digital clock means each include a diode and a zener diode connected to said two potentials which are separated in phase to generate two separate output clock pulses.

6. A fail safe control system as described in claim 5 wherein said fuel burner control circuit means includes flame detection circuit means connected to said spark gap means to sense the presence or absence of a flame at said spark gap means.

7. A fail safe control system as described in claim 6 wherein said digital signal processing means is controlled by said two digital clock means and said flame detection circuit means to ensure phase separated control of said three fuel burner control circuit output means.

8. A fail safe control system as described in claim 7 wherein said three fuel burner functions include a spark generation function, a pilot valve control function, and a main burner control function; said spark generation function and said pilot valve control function being operated by one of said transformers output potentials while said main burner control function is operated by a different one of said transformer means output potentials.

9. A fail safe control system as described in claim 8 wherein each of said solid state gated switch means includes a silicon controlled rectifier.

10. A fail safe control system as described in claim 9 wherein two of said solid state switch means further includes electromagnetic relays as their output control elements.

* * * * *